US006189717B1

(12) United States Patent
Versaw, Jr. et al.

(10) Patent No.: US 6,189,717 B1
(45) Date of Patent: Feb. 20, 2001

(54) INTEGRALLY FORMED TANK SUMP WITH WATER RESISTANT LID ASSEMBLY

(75) Inventors: Robert H. Versaw, Jr.; James W. Mosier, both of Muskegon; Daniel P. Nordstrom, Twin Lake, all of MI (US)

(73) Assignee: Advanced Polymer Technology, Inc., Muskegon, MI (US)

( * ) Notice: Under 35 U.S.C. 154(b), the term of this patent shall be extended for 0 days.

(21) Appl. No.: 09/152,822

(22) Filed: Sep. 14, 1998

(51) Int. Cl.[7] ..... B65D 8/12; B65D 90/02; B65D 90/10

(52) U.S. Cl. ..... 220/62.19; 220/62.22; 220/565; 220/602; 220/672; 220/795

(58) Field of Search ..... 220/254, 670, 220/673, 671, 672, 675, 674, 669, 666, 667, 602, 795, 565, 586, 588, 589, 590, 592, 212, 780, 378, 62.19, 62.22, 62.11, 601, 626, 661, 662

(56) References Cited

U.S. PATENT DOCUMENTS

| | | |
|---|---|---|
| D. 309,308 | 7/1990 | Webb . |
| D. 313,418 | 1/1991 | Webb . |
| D. 322,970 | 1/1992 | Webb . |
| 0,845,760 | 3/1907 | Coffin . |
| 1,317,260 | 9/1919 | Armstrong . |
| 1,582,191 | 4/1926 | Snooke . |
| 1,639,495 | 8/1927 | Frame . |
| 1,712,510 | 5/1929 | Monie . |
| 1,793,038 | 2/1931 | Zimmermann . |
| 2,151,770 | 3/1939 | James . |
| 2,254,668 | 9/1941 | Tomek . |
| 2,310,877 | 2/1943 | Sperry . |
| 2,336,150 | 12/1943 | Horvath . |
| 2,410,999 | 11/1946 | Reisner . |

(List continued on next page.)

FOREIGN PATENT DOCUMENTS

| | | |
|---|---|---|
| 150132 | 5/1951 | (AU) . |
| 200618 | 10/1955 | (AU) . |
| 1068961 | 1/1980 | (CA) . |

(List continued on next page.)

OTHER PUBLICATIONS

Hofit, *Instructions for the Installation of Hofit Chambers*, pp. A1/17—A17/17.

(List continued on next page.)

*Primary Examiner*—Allan N. Shoap
*Assistant Examiner*—Niki M. Eloshway
(74) *Attorney, Agent, or Firm*—Young & Basile, P.C.

(57) ABSTRACT

A sump has a one-piece body, comprising a hollow base member for collecting fluids leaking from a piping system, the base member having an upper portion and a lower portion. The one-piece body further comprises a hollow riser section having an upper portion defining an opening, and a lower portion, the riser lower portion extending upwardly from the base member upper portion, the riser section having sidewalls with a generally corrugated shaped cross section in an axial direction. The hollow base member has a bottom and sidewalls, each of the bottom and sidewalls having an outer surface. The base member is fiberglass encapsulated, which encapsulation comprises a fiberglass woven reinforcement pad layer disposed on the base member bottom outer surface; a chopped fiberglass material layer disposed on the sidewalls outer surface up to and including an area abutting the riser section lower portion; a polymeric coating material layer disposed on the fiberglass woven reinforcement pad layer and the chopped fiberglass material layer; and a polymeric sealant material layer disposed on a portion of the riser section lower portion and on a portion of the polymeric coating material layer, at the area abutting the riser section lower portion. The sump further comprises a lid and a mechanism for mounting the lid to the riser section upper portion in a water resistant manner.

11 Claims, 4 Drawing Sheets

U.S. PATENT DOCUMENTS 2,441,009 5/1948 Cunningham .
2,449,229 9/1948 Hopwood .
2,671,573 3/1954 Hendon et al. .
2,688,497 9/1954 Brisack .
2,691,538 10/1954 Clausen .
2,717,792 9/1955 Pelley .
2,813,692 11/1957 Bremer et al. .
2,870,881 1/1959 Rogge .
2,906,500 9/1959 Knapp et al. .
2,911,001 11/1959 Fuller .
3,010,598 11/1961 Foss .
3,098,663 7/1963 Dibley .
3,178,206 4/1965 Martin et al. .
3,243,240 3/1966 Arthur .
3,362,425 1/1968 Morris et al. .
3,389,560 6/1968 Zemsky .
3,390,224 6/1968 Wyatt .
3,401,958 9/1968 Demyon .
3,408,778 11/1968 Mason .
3,423,518 1/1969 Weagant .
3,439,837 4/1969 Hearn et al. .
3,459,229 8/1969 Croft .
3,518,359 6/1970 Trimble et al. .
3,531,264 9/1970 Greipel .
3,543,377 12/1970 Bremmer .
3,615,034 10/1971 Lemelson .
3,654,382 4/1972 Rubright .
3,707,852 1/1973 Burckhardt et al. .
3,712,009 1/1973 Campagna .
3,715,958 2/1973 Crawford et al. .
3,721,270 3/1973 Wittgenstein .
3,759,280 9/1973 Swanson .
3,802,456 4/1974 Wittgenstein .
3,858,752 1/1975 Marvin, Jr. et al. .
3,859,802 1/1975 Platner et al. .
3,882,976 5/1975 Nash .
3,905,405 9/1975 Fowler et al. .
3,938,285 2/1976 Gilbu .
3,972,440 8/1976 Warren .
3,995,332 12/1976 Forchini et al. .
3,997,760 12/1976 Salinger .
4,062,376 12/1977 McGrath .
4,076,040 2/1978 Alpers et al. .
4,082,301 4/1978 Salinger .
4,089,139 5/1978 Moffa et al. .
4,109,976 8/1978 Koch .
4,132,083 1/1979 McGrath .
4,145,075 3/1979 Holzmann .
4,153,172 * 5/1979 Bialobrzeski ..... 220/666
4,182,581 1/1980 Uehara et al. .
4,215,868 8/1980 Skinner et al. .
4,230,234 10/1980 Taylor .
4,249,758 2/1981 Harris .
4,262,166 4/1981 Radzishevsky et al. .
4,275,757 6/1981 Singer .
4,291,905 9/1981 Schrock .
4,309,128 1/1982 Williams .
4,327,925 5/1982 Alexander et al. .
4,365,829 12/1982 Fowler .
4,387,900 6/1983 Ditcher et al. .
4,449,715 5/1984 Gagas .
4,449,853 5/1984 Mennella et al. .
4,472,911 9/1984 Jooris et al. .
4,492,392 1/1985 Woods et al. .
4,512,148 4/1985 Jacobson .
4,530,443 7/1985 Gorges .
4,540,310 9/1985 Ditcher et al. .
4,552,386 11/1985 Burchette .
4,568,925 2/1986 Butts .
4,619,555 10/1986 Skinner et al. .
4,621,941 11/1986 Ditcher et al. .
4,639,164 1/1987 Pugnale et al. .
4,659,251 4/1987 Petter et al. .
4,667,505 5/1987 Sharp .
4,685,327 8/1987 Sharp .
4,696,330 9/1987 Raudman et al. .
4,702,645 10/1987 Skinner et al. .
4,709,723 12/1987 Sidaway et al. .
4,711,365 12/1987 Fomby .
4,714,095 12/1987 Muller et al. .
4,717,036 1/1988 Dundas et al. .
4,731,501 3/1988 Clark et al. .
4,747,453 5/1988 Howard, Sr. .
4,763,806 8/1988 Podgers et al. .
4,767,108 8/1988 Tanaka et al. .
4,770,317 9/1988 Podgers et al. .
4,770,562 9/1988 Muller et al. .
4,775,073 10/1988 Webb .
4,782,430 11/1988 Robbins et al. .
4,797,513 1/1989 Ono et al. .
4,805,444 2/1989 Webb .
4,809,866 3/1989 Crocker .
4,870,856 10/1989 Sharp .
4,871,084 10/1989 Robbins .
4,890,863 1/1990 Westhoff et al. .
4,896,705 1/1990 Podgers et al. .
4,905,940 3/1990 Luka .
4,912,287 3/1990 Ono et al. .
4,924,923 5/1990 Boehmer et al. .
4,928,349 5/1990 Oikawa et al. .
4,932,257 6/1990 Webb .
4,958,957 9/1990 Berg et al. .
4,961,670 10/1990 McKenzie et al. .
4,968,179 11/1990 Frahm .
4,971,225 11/1990 Bravo .
4,971,477 11/1990 Webb et al. .
5,002,428 3/1991 Shettel .
5,030,033 7/1991 Heintzelman et al. .
5,039,137 8/1991 Cankovic et al. .
5,040,408 8/1991 Webb .
5,054,794 10/1991 Westhoff et al. .
5,058,633 10/1991 Sharp .
5,060,509 10/1991 Webb .
5,062,457 11/1991 Timmons .
5,076,456 12/1991 Geyer .
5,085,257 2/1992 Smith .
5,098,221 3/1992 Osborne .
5,099,894 3/1992 Mozeley, Jr. .
5,105,966 4/1992 Fort et al. .
5,114,271 5/1992 Sunderhaus et al. .
5,117,877 6/1992 Sharp .
5,129,428 7/1992 Winter et al. .
5,129,684 7/1992 Lawrence et al. .
5,134,878 8/1992 Sharp .
5,150,927 9/1992 Skinner .
5,156,292 10/1992 Ross .
5,209,601 5/1993 Odill et al. .
5,246,133 * 9/1993 James ..... 220/602
5,257,652 11/1993 Lawrence .
5,263,794 11/1993 Webb .
5,271,518 12/1993 Webb .
5,295,760 3/1994 Rowe .
5,297,896 3/1994 Webb .
5,328,047 * 7/1994 Smith ..... 220/795
5,333,490 8/1994 Webb .
5,366,318 11/1994 Brancher .
5,372,453 12/1994 Argandona .
5,398,976 3/1995 Webb .
5,423,447 6/1995 Youngs .
5,431,457 7/1995 Youngs .
5,481,790 1/1996 Koreis et al. .

| | | | | |
|---|---|---|---|---|
| 5,482,400 | | 1/1996 | Bavington . | |
| 5,490,419 | | 2/1996 | Webb . | |
| 5,501,472 | | 3/1996 | Brancher et al. . | |
| 5,672,641 | * | 9/1997 | Beer et al. | 521/214 |
| 5,722,699 | | 3/1998 | Brancher . | |
| 5,816,426 | * | 10/1998 | Sharp | 220/62.19 |

FOREIGN PATENT DOCUMENTS

| | | |
|---|---|---|
| 2047354 | 1/1992 | (CA) . |
| 0424638 | 5/1967 | (CH) . |
| 0951281 | 10/1956 | (DE) . |
| 2253857 | 5/1973 | (DE) . |
| 2226508 | 12/1973 | (DE) . |
| 3016401 | 2/1981 | (DE) . |
| 0944434 | 11/1948 | (FR) . |
| 1496531 | 9/1967 | (FR) . |
| 0209931 | 1/1924 | (GB) . |
| 0595584 | 12/1947 | (GB) . |
| 0632756 | 12/1949 | (GB) . |
| 0667165 | 2/1952 | (GB) . |
| 1087178 | 10/1967 | (GB) . |
| 1144475 | 3/1969 | (GB) . |
| 3-51430 | 3/1991 | (JP) . |
| 0245418 | 6/1969 | (SU) . |
| 1352272 | 11/1987 | (SU) . |
| WO 90/04157 | 4/1990 | (WO) . |
| WO 90/07074 | 6/1990 | (WO) . |
| WO 93/17266 | 9/1993 | (WO) . |
| WO 94/09998 | 4/1995 | (WO) . |

OTHER PUBLICATIONS

Owens–Corning Fiberglas, *Piping Sumps—For Secondary Containment of Pumps & Piping (Installation & Specification)*, pp. 1–9 (Dec. 1985).

Advanced Polymer Technology Inc., *APT Tech–Notes—Flexible Entry Boot Installation*, Issue 102 (Sep. 1993).

Total Containment Inc., *Multisided Tank Sumps*(Jul. 1, 1994).

Total Containment Inc., *Sump/Risers*.

Total Containment Inc., *Sump/Risers—Installation Instructions*(Apr. 15, 1989).

Total Containment Inc., *Sump/Riser Installation Instructions for Single Access Lids*(Nov. 23, 1992).

Total Containment Inc., *Enviroflex—Flexible Double–Wall Piping System*(Mar. 1, 1991).

Environ Products Inc., *Environ Safe Products—Designed for Future Generations*(1993).

Environ Products Inc., *Installation Instructions—Deep Burial Sumps*(Sep. 1, 1993).

Reichhold Chemicals, Inc., *ATLAC 490 Modified Terephthalic Polyester Resins*, Product Bulletin, pp. 1–4 (Apr. 1997).

Polydyne, Inc., Material Safety Data Sheet for Methyl Methacrylate (MMA), pp. 1–2 (Jun. 5, 1997).

The R.J. Marshall Co., Material Safety Data Sheet for Densified Chips (Alumina Trihydrate), pp. 1–6, (Mar. 31, 1997).

Brunswick Technologies Inc., Material Safety Data Sheet for "1708" Fiberglass Reinforcement Fabric, pp. 1–5 (May 2, 1997).

Owens Corning, Material Safety Data Sheet for Fibrous Glass (Cardable Fiber, Chopped Strand, et al.), pp. 1–10, Jun. 6, 1997.

Cook Composites and Polymers Co., Material Safety Data Sheet for Polycor, pp. 1–6 (Nov. 10, 1994).

Minnesota Mining and Manufacturing Co., Material Safety Data Sheet for 3M Marine Adhesive Sealant Fast Cure 5200, pp. 1–7 (Nov. 10, 1997).

* cited by examiner

INTEGRALLY FORMED TANK SUMP WITH WATER RESISTANT LID ASSEMBLY

BACKGROUND OF THE INVENTION

The present invention relates generally to fluid containment systems and, more particularly, to a sump for containing spillage, or the like, in systems storing hazardous fluids and/or chemicals, such as gasoline.

Sumps, in general, are employed in fluid storage systems to contain spillage, or the like, to prevent waste. In the case of hazardous materials, sumps are also used to prevent the escape of these hazardous materials and the possible safety and pollution problems that such escape could create. In gasoline storage systems, in particular, sumps may be used at junction points where spillage of hazardous materials, if any, typically occurs. In these sumps, there may or may not exist retrieval systems for the spilled materials. The sumps, however, are usually accessible for inspection and/or for draining the material either automatically or manually.

In designing these containment systems, as well as in modernizing old systems, various types of sumps are needed for junction points in the storage plumbing system between the pumps and the storage tanks as well as at the storage filling points. Different systems with different types of hardware require varying sizes of sumps to conform to the needs of a particular system.

Adjustable sumps have been developed and are used in the field of gasoline storage systems, but are generally inconvenient to use. Sumps presently exist where the housing of the sump is adjustable using sliding and bellows-type connections for adjusting the vertical height of the sump. Also, sumps with score lines on the housings exist for cutting and taping together the sump housing for installment in the system. These systems result in sumps that leak and must be repaired or replaced frequently to avoid the escape of hazardous wastes.

In addition to being inconvenient to use and maintain, sumps generally in use at present are rather expensive to manufacture, install and maintain. Also, numerous clamping features in conventional sump lid assemblies are used in order to attempt to insure water tightness; however, these features create undesirable, added motion when removing and/or positioning the lid on the sump. Further, one sump is generally dedicated to the needs of one particular site. This adds to the cost of manufacture due to the added cost of separate tooling and the like, as well as the need for increased inventory reserve. As a consequence, these increased costs translate into increased costs for the consumer. Further, in addition to conventional sumps being generally inadequately water resistant, they also may not be adequately gasoline and gasoline blend resistant, corrosion resistant, nor do they generally include flame and smoke retardants. As can readily be appreciated, this lack of features may be inconvenient, and may also be hazardous in some instances.

Thus, it is an object of the present invention to provide a sump which is simple to manufacture. It is a further object of the present invention to provide such a sump which will allow ease of periodical inspection with less motion, while maintaining water resistance. It is yet another object of the present invention to provide such a sump which includes strengthening features to substantially prevent the sump from collapsing or deforming to the point where subassembly components malfunction or do not substantially meet expectations. Yet further, it is an object of the present invention to provide a sump which is advantageously substantially gasoline and gasoline blend resistant and corrosion resistant. It is also an object of the present invention to provide such a sump which includes flame and smoke retardants which advantageously may provide extra safety features in certain situations. Still further, it is an object of the present invention to provide such a sump which is cost effective to manufacture in various heights and widths.

SUMMARY OF THE INVENTION

The present invention addresses and solves the abovementioned problems and meets the enumerated objects and advantages, as well as others not enumerated, by providing a tank and/or dispenser sump which comprises a one-piece body which includes a hollow base member for collecting fluids leaking from a piping system, the base member having an upper portion and a lower portion. A hollow riser section has an upper portion defining an opening, and a lower portion, the riser lower portion extending upwardly from the base member upper portion. The riser section has sidewalls with a generally corrugated shaped cross section in an axial direction. The hollow base member has a bottom and sidewalls, each of the bottom and sidewalls having an outer surface. The base member is fiberglass encapsulated, which encapsulation comprises a fiberglass woven reinforcement pad layer disposed on the base member bottom outer surface; a chopped fiberglass material layer disposed on the sidewalls outer surface up to and including an area abutting the riser section lower portion; a polymeric coating material layer disposed on the fiberglass woven reinforcement pad layer and the chopped fiberglass material layer; and a polymeric sealant material layer disposed on a portion of the riser section lower portion and on a portion of the polymeric coating material layer, at the area abutting the riser section lower portion. The sump further comprises a lid, as well as means for mounting the lid to the riser section upper portion in a water resistant manner.

BRIEF DESCRIPTION OF THE DRAWINGS

Other objects, features and advantages of the present invention will become apparent by reference to the following detailed description and drawings, in which.

DETAILED DESCRIPTION OF THE PREFERRED EMBODIMENTS

Figure 1:
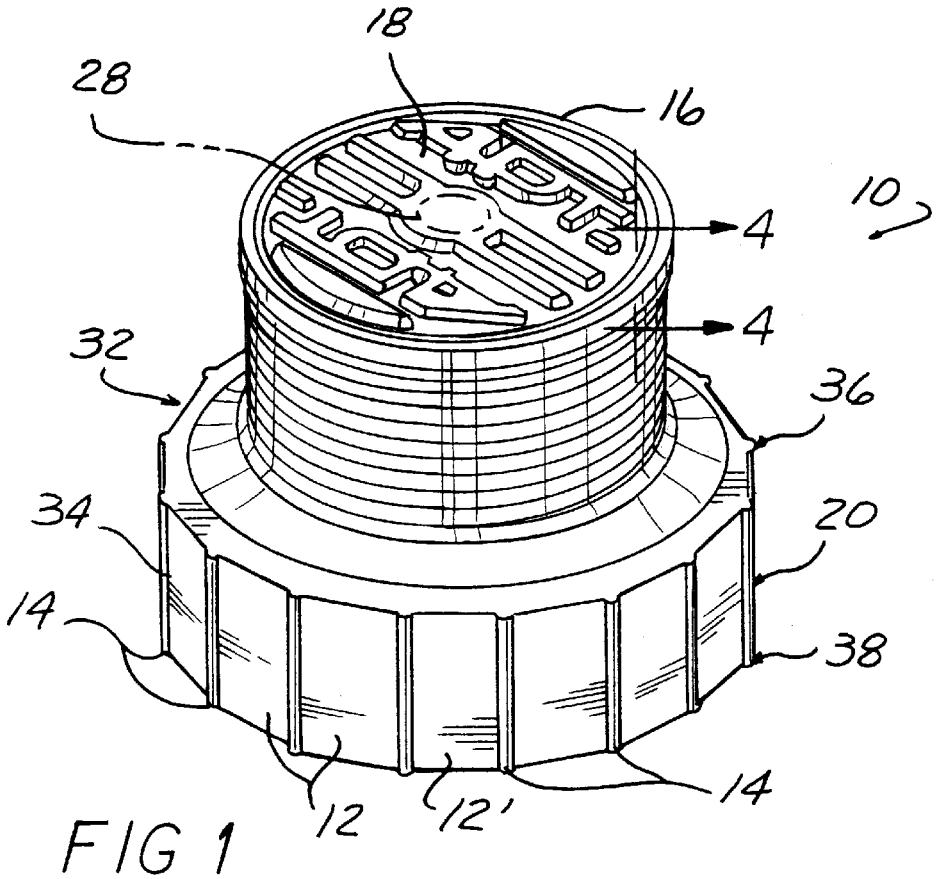
FIG. 1 is a perspective view of a tank sump of the present invention shown with the lid assembly mounted thereon.

Referring now to FIG. 1, the sump of the present invention is designated generally as 10. Sump 10 is generally referred to as a "tank" sump herein, but it is to be understood that sump 10 may also comprise a "dispenser" sump; and it is to be further understood that sump 10 may be used in any other suitable application which would have need of a containment sump. The sump 10 is adapted to be installed substantially below the ground level, and may have a flexible secondary containment piping system (not shown) running therethrough. The secondary containment piping system may have a flexible primary supply pipe carried within a flexible, outer secondary containment pipe. The outer containment pipe is adapted to extend into the sump 10 a sufficient distance so that it clears the interior of the wall 20 of the sump 10. During fabrication, this will permit the insertion on the terminated end of the outer containment pipe of a suitable air pressure device to permit testing. The inner pipe may extend past the terminated end of the outer pipe a sufficient distance to permit it to be coupled by suitable conventional couplings to another inner pipe, which in turn extends outwardly from the sump 10 through an outer containment pipe. The piping system may eventually run to a dispenser mounted on concrete.

The outer containment pipe with an inner supply pipe therein may be connected to the sump 10 in a fluid tight manner by a suitable flexible entry boot. When the entry boot is to be installed, a suitable bore is made in the sump 10 at an appropriate location, as required by the particular site. One example of a suitable flexible entry boot is disclosed in U.S. Pat. No. 5,431,457, which is incorporated herein by reference.

Figure 2:
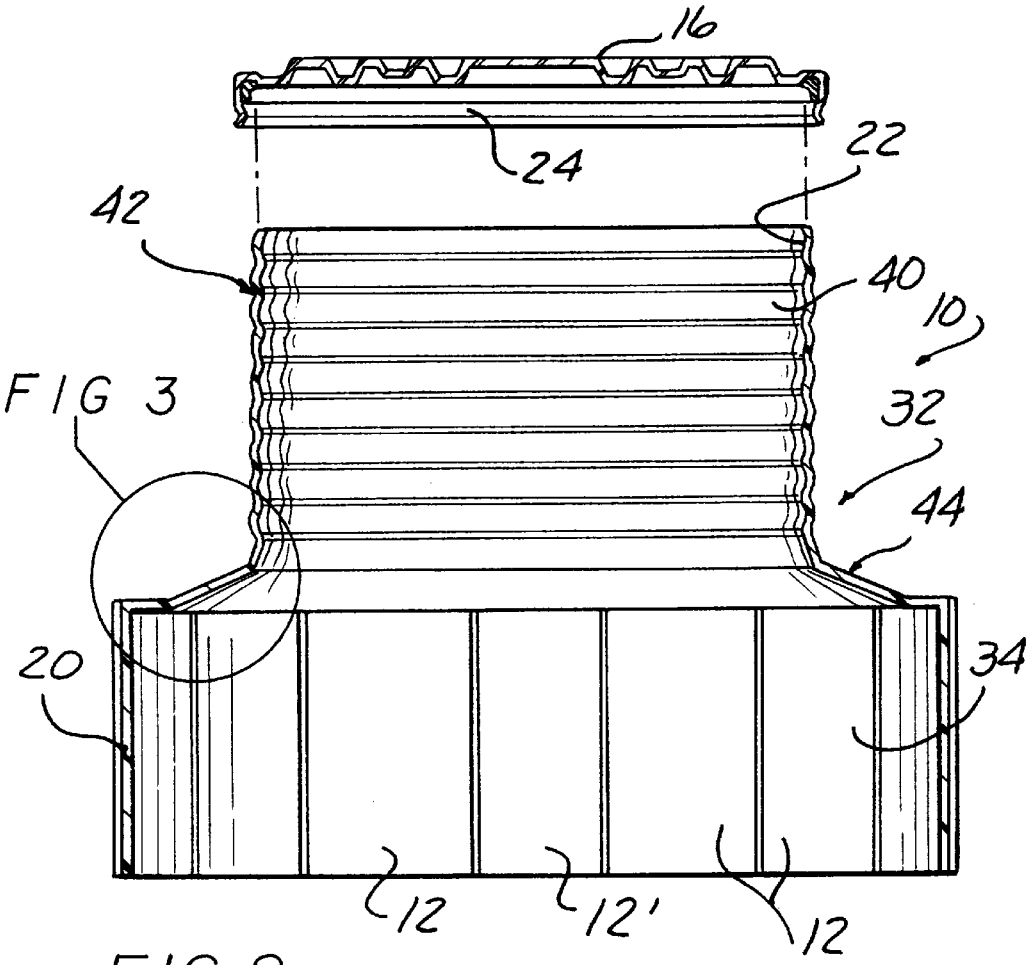
FIG. 2 is a front, cross sectional view of the tank sump of FIG. 1 with the lid assembly exploded away.

As can best be seen in FIGS. 1 and 2, the tank sump 10 comprises a one-piece body 32 having a hollow base member 34 for collecting fluids which may leak from a piping system. The base member 34 has an upper portion 36 and a lower portion 38. The base member 34 may be formed from a plurality of panels 12, each panel 12 integrally joined to an adjacent panel by vertically and outwardly extending beads 14, wherein at least one panel 12 is adapted to have a flexible entry boot (not shown) installed therein. Among other advantages, the beads 14 provide added rigidity to the base member 34. Beads 14 also add strength when the sump 10 is being compacted or subjected to high water tables. Still further, beads 14 may define regions where penetration boots (not shown) are to be installed. Although in the preferred embodiment each of the panels 12 are substantially the same width, an alternate preferred embodiment includes at least one panel 12' which is somewhat narrower. This panel 12' may be desirable in that it may more easily signal the installer to a more suitable area to have electrical conduits passing therethrough.

It is to be understood that the base member 34 may come in a variety of diameters, for example, 45 inches, 47 inches, etc.

Figure 3:
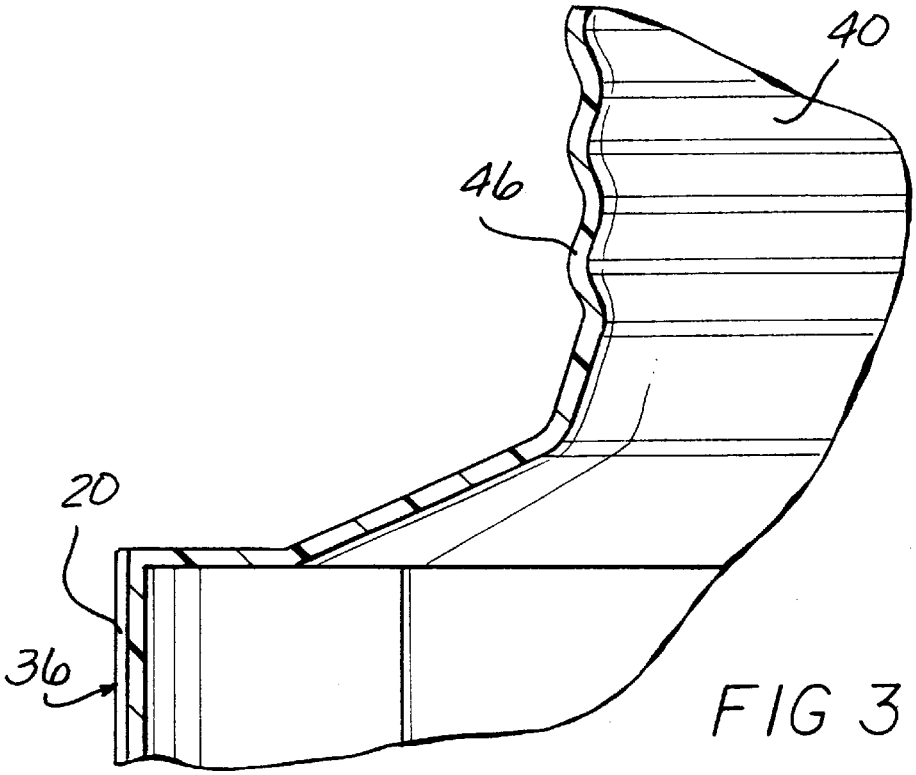
FIG. 3 is an enlarged cutaway cross sectional view of the portion of the sump shown in FIG. 2.
Figure 4:
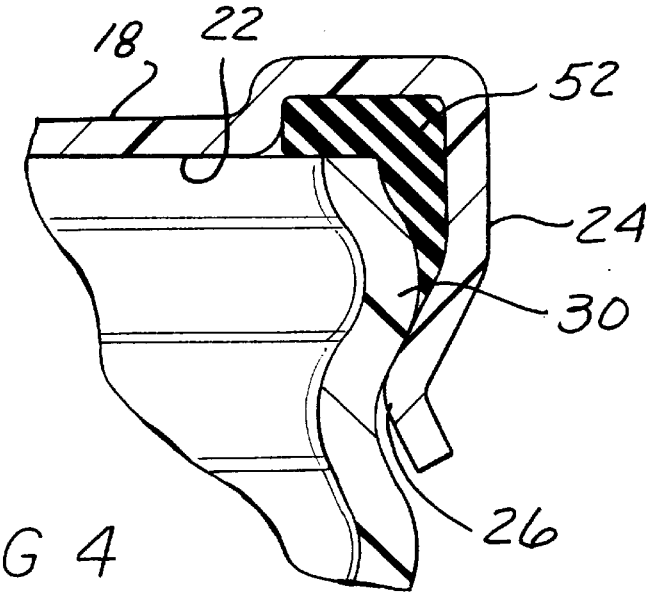
FIG. 4 is an enlarged cutaway cross sectional view taken on line 4—4 in FIG. 1.

The one-piece body 32 further comprises a hollow riser section 40 having an upper portion 42 defining an opening 22, and a lower portion 44, the riser lower portion 44 extending upwardly from the base member upper portion 36. The riser section 40 has sidewalls 46 with a generally corrugated shaped cross section in an axial direction, as best seen in FIG. 3. This corrugated shaped cross section is advantageous in that it adds stiffness in the radial direction; as well as defining height adjustment levels, among other advantages. As best seen in FIG. 4, the riser section upper portion 42 may have a radially outward extending annular projection 30 adjacent the opening 22.

It is to be understood that the riser section 40 may have any suitable diameter, for example about 36 inches, about 42 inches, etc. This allows the riser section 40 to accommodate a 36 inch manhole, a 42 inch manhole, etc. The riser section 40 may also be molded of any desired height to fit a particular site. For example, the sump shown in FIGS. 1 and 2 has a riser section 40 adapted for a "medium" burial depth. As illustrative, non-limitative examples, riser section 40 may be adapted to accommodate a "shallow" burial depth, ranging between about 21 inches and about 33 inches; or between about 18⅝ inches and about 32⅝ inches; and/or section 40 may be adapted to accommodate a "medium" burial depth, ranging between about 24 inches and about 40 inches; or between about 23⅝ inches and about 39⅝ inches.

The tank sump 10 further comprises a lid 16 having an outer periphery, a surface 18 adapted to cover the opening 22, and an annular rim 24 extending generally downwardly from the lid surface 18. Annular rim 24 may have a radially inward projection 26 extending therefrom. The lid 16 permits access to the interior of the sump 10 when removed, and substantially prevents dust, particulate contaminants and water from entering the interior of the sump 10 when installed.

Lid 16 may further comprise an inspection port 28, as shown in phantom in FIG. 1. This port 28 advantageously allows visual inspection of the interior of sump 10 without removing the entire lid 16. If desired, lid 16 may also include molded alphanumeric characters, as shown in FIG. 1.

Figure 5:
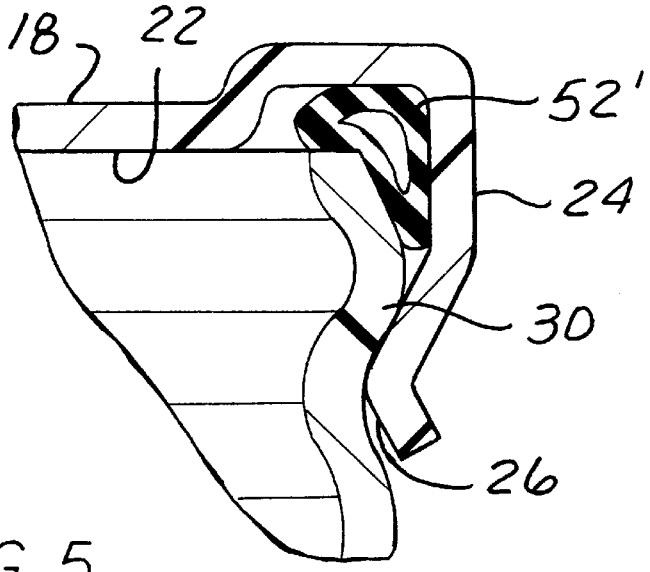
FIG. 5 is an enlarged cutaway cross sectional view, similar to that of FIG. 4, showing an alternate embodiment of the gasket.

Tank sump 10 may further comprise a gasket 52 extending between the lid 16 outer periphery and an area of the riser section upper portion 42 adjacent the opening 22. It is to be understood that the gasket 52 may be formed from any material suitable for sealing. However, in the preferred embodiment, the gasket is formed from a flexible, water and hydrocarbon resistant material, such as nitrile rubber. An alternate preferred embodiment of the gasket is shown in FIG. 5. As can be seen, gasket 52' has a hollow cross section. Gasket 52' is also formed from any material suitable for sealing; but, in the preferred embodiment, is formed from a flexible, water and hydrocarbon resistant material, such as nitrile rubber.

The tank sump 10 may further comprise means for releasably mounting the lid 16 to the riser section upper portion 42 in a water resistant manner with the gasket 52 therebetween. It is to be understood that this mounting means may comprise any suitable means. However, in the preferred embodiment, the mounting means comprises the rim inward projection 26 being snap fit over the riser section outward projection 30, as best seen in FIGS. 4 and 5.

It is to be understood that tank sump 10 may be formed from any suitable material, such as polyethylene, nylon, polypropylene or fiberglass reinforced plastic, however, in the preferred embodiment, it is made of a polymeric material resistant to water and hydrocarbons, for example, cross-linked polyethylene. The one-piece body 32 may be molded by any suitable process, such as blow molding or injection molding, however, in the preferred embodiment, the sump 10 is rotationally molded.

Figure 6:
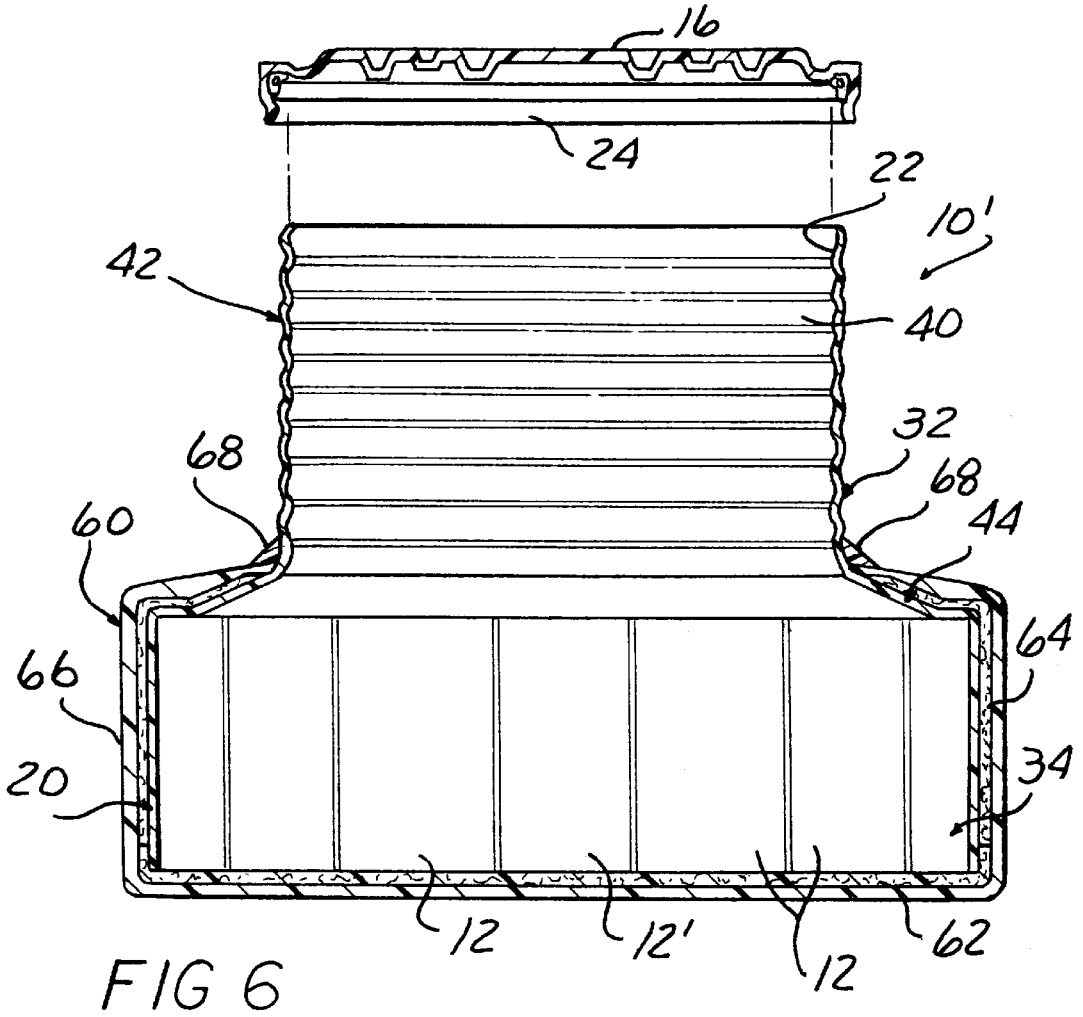
FIG. 6 is a front, cross sectional view of an alternate embodiment of the tank sump of the present invention with the lid assembly exploded away.

Referring now to FIG. 6, an alternate embodiment of the sump of the present invention is designated generally as 10'. Sump 10' includes the features as described above in relation to sump 10. However, in addition, sump 10' includes fiberglass encapsulation 60 generally around the base member 34. The fiberglass encapsulation 60 may comprise a fiberglass woven pad material 62 disposed about the bottom surface of the base member 34. A chopped fiberglass material 64 may cover the wall 20 comprising panels 12 and/or 12' of the base member 34. Fiberglass encapsulation 60 may further comprise a polymeric coating material 66 covering both the pad material 62 and the chopped fiberglass material 64. At the area where the coating material 66 meets the riser section 40, a polymeric sealant material 68 may be applied to help prevent water migration between the material from which the sump 10' is formed and the fiberglass encapsulation 60.

It is contemplated that the pad 62 may cover both of the bottom of the base member 34 and the wall 20 thereof. It is to also be understood that pad 62 may be eliminated if the extra reinforcement is deemed unnecessary; and, in such cases, the chopped fiberglass material 64 may cover both the bottom of the base member 34 and the wall 20 thereof, if desired. Further, any mixture of the pad 62 and chopped material 64 may be used in any suitable area of the sump 10'.

It is to be understood that the pad material 62 may comprise any suitable material. However, in the preferred embodiment, this material 62 is formed from a material commercially available from Brunswick Technologies, Inc. in Brunswick, Ma. under the trade name 1708. This material is a fiberglass reinforcement fabric having a boiling point and a melting point above about 1600° F., and a softening point above 1550° F.

The chopped fiberglass material 64 may comprise any suitable material; however, in the preferred embodiment, this material 64 is formed from a material commercially available from Owens Corning in Toledo, Ohio under the trade names Chopped Strand; Cordage, Flakeglas, Wet Chop, as well as others. This material is commonly known as fiber glass continuous filament.

The polymeric coating material 66 may comprise any suitable material. However, in the preferred embodiment, coating material 66 is formed from a modified terephthalic polyester resin commercially available under the trade name ATLAC 490 series resins from Reichhold Chemicals, Inc. in Research Triangle Park, N.C. The ATLAC 490 series resins are prepromoted, thixotropic, corrosion- and temperature-resistant; and feature a very high molecular weight and crosslink density, and offer excellent solvent resistance and retention of physical properties at elevated temperatures. An alternate polymeric coating material is commercially available under the trade name POLYCOR from Cook Composites and Polymers Co. in North Kansas City, Mo.

For improved flame and smoke retardant properties, the coating material 66 may have several additives mixed therein. Although not to be considered limitative, two of the additives as in the preferred embodiment are methyl methacrylate (MMA) and aluminum trihydrate.

The polymeric sealant material 68 may comprise any suitable material. However, in the preferred embodiment, this material 68 is formed from a material commercially available under the trade name 3M Marine Adhesive Sealant Fast Cure 5200 from Minnesota Mining and Manufacturing Company in St. Paul, Minn. The Fast Cure 5200 comprises urethane prepolymer; titanium dioxide; zinc oxide; synthetic amorphous silica, fumed, crystalline free; silica; acrylate polymer—New Jersey trade secret registry no. 04499600-5575P; alumina trihydrate; p,p'-methylenebis(phenyl isocyanate); heptane; acetone; cyclohexane; and toluene.

The thickness of the encapsulation 60 may be any suitable thickness; however, in the preferred embodiment, the thickness of encapsulation 60 is about 0.1875 inches, for a total thickness of the wall 20 of sump 10' including the encapsulation 60 being about 0.5 inches.

Figure 7A:
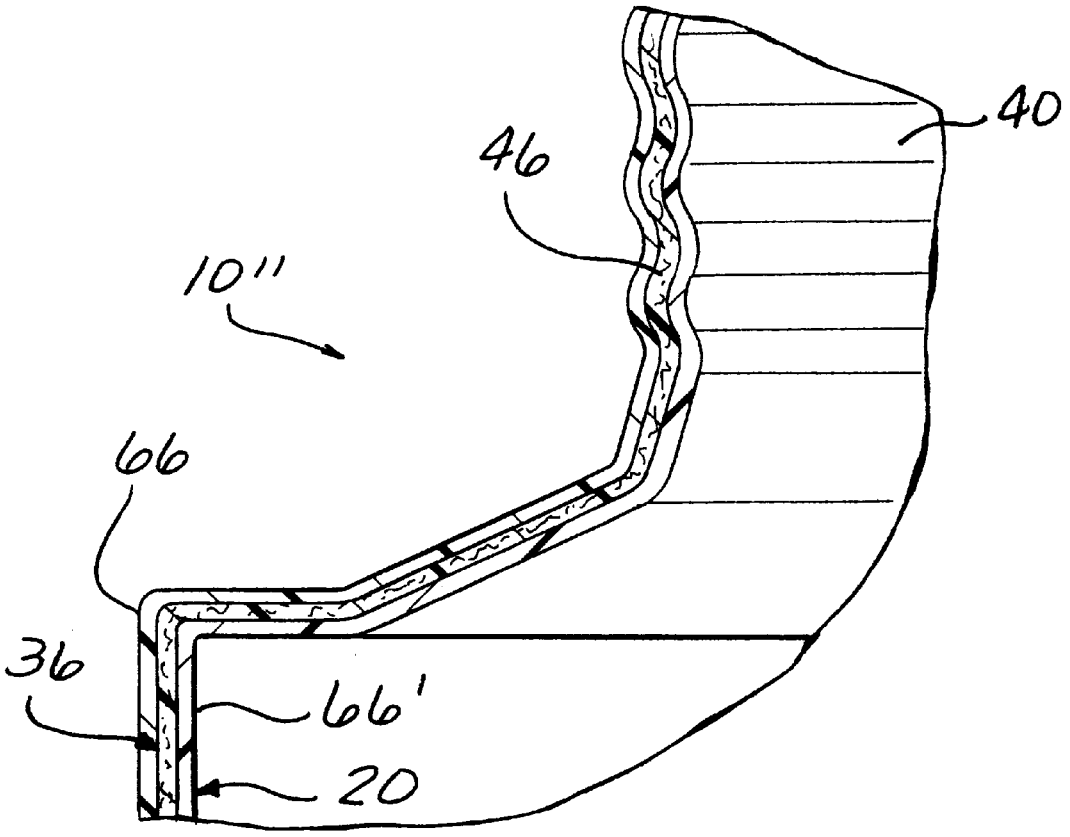
FIG. 7A is an enlarged cutaway cross sectional view of a further alternate embodiment of the sump of the present invention, showing a portion of the upper area of the base and a portion of the riser section.
Figure 7B:
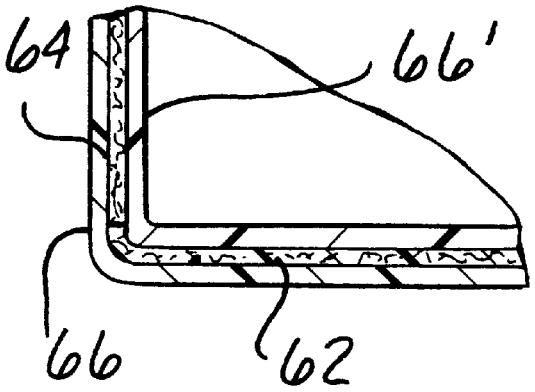
FIG. 7B is an enlarged cutaway cross sectional view of the sump of FIG. 7A, showing a portion of the bottom of the base member.

Referring now to FIGS. 7A and 7B, a further alternate embodiment of the sump of the present invention is designated generally as 10". Sump 10" includes the features as described above in relation to sump 10, with the following exception. Instead of the sump being formed from, for example, polyethylene, the one-piece body 32 is formed substantially entirely from fiberglass.

In the preferred embodiment, the fiberglass may comprise the fiberglass woven pad 62 (for added reinforcement, if desired) forming the bottom portion of base member 34, with the chopped fiberglass material 64 comprising the walls 20 and 46 of one-piece body 32. Or, if desired, the chopped fiberglass material 64 may comprise the entire one-piece body 32; or, the fiberglass woven pad 62 may comprise the entire one-piece body; or any mixture of the two in any suitable area of the sump 10".

Sump 10" further comprises a polymeric coating material 66 disposed on the outside of one-piece body 32, as well as a polymeric coating material 66' disposed on the inside of one-piece body 32. The polymeric sealant material 68 (not shown in FIGS. 7A and 7B) may be used in any suitable area (such as at an area in the wall 20 through which a section has been removed to accommodate an entry/bulkhead boot), if desired and/or necessary.

The materials suitable for use as the fiberglass woven pad 62, the chopped fiberglass material 64, the polymeric coating material 66, and the polymeric sealant material 68 are as described above with regard to sump 10'.

The sump 10" may have any suitable wall 20, 46 thickness as desired. However, in the preferred embodiment, the wall 20, 46 thickness may be about 0.25 inches.

The lid 16 for each of the sump 10, the fiberglass encapsulated sump 10' and the fiberglass sump 10" may be formed from any suitable material, such as polyethylene, nylon, polypropylene or fiberglass reinforced plastic, however, in the preferred embodiment, it is made of a polymeric material resistant to water and hydrocarbons, for example, cross-linked polyethylene.

The fiberglass encapsulated sump 10' and the fiberglass sump 10" provide added strength, as well as improved gasoline and gasoline blend resistance, corrosion resistance, and flame and smoke retarding properties.

The sump 10, 10' and 10" as described hereinabove achieve, but are not limited to, the objects and advantages described more fully above.

While preferred embodiments, forms and arrangements of parts of the invention have been described in detail, it will be apparent to those skilled in the art that the disclosed embodiments may be modified. Therefore, the foregoing description is to be considered exemplary rather than limiting, and the true scope of the invention is that defined in the following claims.

What is claimed is:

1. A sump, comprising:

a one-piece body, comprising:

a hollow base member for collecting fluids leaking from a piping system, the base member having an upper portion and a lower portion; and a hollow riser section having an upper portion defining an opening, and a lower portion, the riser lower portion extending upwardly from the base member upper portion, the riser section having sidewalls with a generally corrugated shaped cross section in an axial direction;

wherein the hollow base member has a bottom and sidewalls, each of the bottom and sidewalls having an outer surface, the base member being fiberglass encapsulated, the fiberglass encapsulation comprising:

a fiberglass woven reinforcement pad layer disposed on the base member bottom outer surface;

a chopped fiberglass material layer disposed on the sidewalls outer surface up to and including an area abutting the riser section lower portion;

a polymeric coating material layer disposed on the fiberglass woven reinforcement pad layer and the chopped fiberglass material layer; and a polymeric sealant material layer disposed on a portion of the riser section lower portion and on a portion of the polymeric coating material layer, at the area abutting the riser section lower portions;

a lid; and means for mounting the lid to the riser section upper portion in a water resistant manner.

2. The sump as defined in claim 1 wherein the sump has an interior, and wherein the lid further comprises an inspection port.

3. The sump as defined in claim 1 wherein the sump has an interior, and wherein the lid is releasably attached to the riser section upper portion, and further wherein the lid permits access to the interior of the sump when removed, and substantially prevents dust, particulate contaminants and water from entering the interior of the sump when installed.

4. The sump as defined in claim 1 wherein the lid has an outer periphery, the sump further comprising a gasket extending between the lid outer periphery and an area of the riser section upper portion adjacent the opening.

5. The sump as defined in claim 4 wherein the riser section upper portion area has a radially outward extending annular projection, and wherein the lid further comprises:

a surface adapted to cover the opening; and an annular rim extending generally downwardly from the lid surface and having a radially inward projection extending therefrom;

wherein the mounting means comprises the rim inward projection being snap fit over the riser section outward projection.

6. The sump as defined in claim 4 wherein the gasket is formed from a flexible, water and hydrocarbon resistant material.

7. The sump as defined in claim 1 wherein the sump is formed from a polymeric material resistant to water and hydrocarbons.

8. The sump as defined in claim 1 wherein the base member has a periphery, and wherein the base member is formed from a plurality of panels, each panel integrally joined to an adjacent panel by vertically and outwardly extending beads.

9. The sump as defined in claim 8 wherein at least one panel is adapted to have a flexible entry boot installed therein.

10. The sump as defined in claim 8 wherein at least one panel is adapted to have electrical conduits passing therethrough.

11. The sump as defined in claim 1 wherein the polymeric coating material layer includes an additive for at least one of improved flame retardant properties and improved smoke retardant properties.

* * * * *